US007238123B2

(12) United States Patent
Watanabe

(10) Patent No.: US 7,238,123 B2
(45) **Date of Patent: *Jul. 3, 2007**

(54) MULTI-PIECE SOLID GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/119,740

(22) Filed: May 3, 2005

(65) Prior Publication Data

US 2005/0192121 A1 Sep. 1, 2005

Related U.S. Application Data

(62) Division of application No. 10/379,594, filed on Mar. 6, 2003, now Pat. No. 6,910,974.

(30) Foreign Application Priority Data

Mar. 8, 2002 (JP) ..... 2002-063520
Mar. 8, 2002 (JP) ..... 2002-063530

(51) Int. Cl.
*A63B 37/06* (2006.01)

(52) U.S. Cl. ..... 473/376

(58) Field of Classification Search ..... 473/373, 473/367, 368, 374, 376
See application file for complete search history.

(56) References Cited

U.S. PATENT DOCUMENTS 6,126,558 A * 10/2000 Higuchi et al. ..... 473/374
6,558,275 B2 * 5/2003 Ohama ..... 473/373
6,910,974 B2 * 6/2005 Watanabe ..... 473/377

* cited by examiner

*Primary Examiner*—Raeann Trimiew
(74) *Attorney, Agent, or Firm*—Sughrue Mion, PLLC

(57) ABSTRACT

In a multi-piece solid golf ball comprising a solid core, an intermediate layer, and a cover, the solid core is formed mainly of an organosulfur compound-containing base rubber, the intermediate layer is formed mainly of a base resin containing at least 50% by weight of a polyurethane elastomer, the cover is formed mainly of a polyurethane elastomer, and the Shore D hardnesses of the layers are controlled. The golf ball has excellent travel distance and feel as well as improved scuff resistance and durability to repeated impact.

7 Claims, No Drawings

MULTI-PIECE SOLID GOLF BALL

This is a divisional of Application No. 10/379,594 filed Mar. 6, 2003 now U.S. Pat. No. 6,910,974.

This invention relates to multi-piece solid golf balls comprising a solid core, at least one intermediate layer and a cover.

BACKGROUND OF THE INVENTION

For the purpose of improving the feel and travel distance of golf balls on full shots with different clubs, development of golf balls using various elastomers in the intermediate layer or the cover is currently in progress. Such golf balls are disclosed, for example, in U.S. Pat. No. 5,556,098, JP-A 10-108923 and U.S. Pat. No. 6,315,680.

More particularly, Higuchi et al., U.S. Pat. No. 5,556,098, assigned to the same assignee as the present invention, describes a three-piece solid golf ball using a polyester thermoplastic elastomer in the intermediate layer and an ionomer resin in the cover. Since the intermediate layer and the cover are made of different materials, a problem arises in the bond therebetween. The ball is somewhat less durable against repeated shots.

JP-A 10-108923 describes a multi-piece solid golf ball using a mixture of a polyurethane thermoplastic resin and an ionomer resin in the intermediate layer. Since the cover is made of an ionomer resin, the ball yet suffers from durability and needs some improvement in rebound.

Dalton et al., U.S. Pat. No. 6,315,680 describes a golf ball comprising a hard mantle layer having a Shore D hardness greater than 60 and comprised of a thermoplastic polyurethane or a thermoplastic polyester. Due to the hard mantle layer, the ball gives an unpleasant feel when hit with short irons, typically iron No. 9, and needs some improvement in rebound.

These golf balls use relatively soft cover materials as typified by ionomer resins as mentioned above. Upon repeated shots, the balls are likely to be scraped by the abutment of the edge and head of iron clubs against the ball surface. The balls are less resistant to scuffing as well. Upon repeated shots, cracks can occur. These indicate insufficient durability against repeated impact.

On the other hand, one-piece balls having improved durability and two-piece balls having relatively good flight performance are used as practice golf balls. However, the one-piece balls largely differ from balls for normal play in that they are extremely low in rebound and upon full shots with a driver or iron, follow a high-rise trajectory due to excessive spin reception.

The two-piece balls for practice have a cover of a hard ionomer resin. They receive a spin rate which is too low as compared with the quality balls professional and skilled golfers use on the course. The balls are less resistant to scuffing as well. These balls are thus inadequate for professional and skilled golfers to use in practice.

Among the quality balls professional and skilled golfers currently play on the course, multi-piece solid golf balls, typically three-piece solid golf balls using polyurethane elastomer as the cover enjoy widespread use. These balls are excellent in properties including flight, feel and spin, and fairly improved in durability. However, the durability is insufficient as the balls to be repeatedly hit numerous times for practice purposes.

JP-A 2001-54588 discloses a three-piece golf ball using a thermoplastic polyurethane elastomer as the cover. The polyurethane elastomer forms a poor bond with the ionomer resin of which the intermediate layer is formed. As a result, a primer must be applied to the intermediate layer after the intermediate layer is formed around the core and before the cover is formed thereon. There is left a room for improvement in productivity.

JP-A 9-215778 describes a two-piece golf ball using a thermoplastic polyurethane elastomer as the cover. This two-piece golf ball does not give rise to the poor bond problem as mentioned just above, but receives too much spin on shots with a driver or iron and hence, travels a rather skying trajectory, as compared with the three-piece ball having a high hardness intermediate layer between the cover and the core.

SUMMARY OF THE INVENTION

A first object of the invention is to provide a golf ball having excellent travel distance and feel as well as improved scuff resistance and durability against repeated impact.

A second object of the invention is to provide a golf ball which is improved in travel distance over one-piece balls, comparable in spin and trajectory with conventional three-piece golf balls having a thermoplastic polyurethane elastomer cover professional and skilled golfers use on the course, improved in scuff resistance and durability against repeated impact, and good in productivity.

It has been found that in a multi-piece solid golf ball comprising a solid core, at least one intermediate layer and a cover, the first object is attained by forming the solid core from an organosulfur compound-containing base rubber, the intermediate layer from a polyurethane elastomer-containing base resin, and the cover from a polyurethane elastomer, and optimizing the hardness difference between and the total gage of the intermediate layer and the cover. The resulting golf ball exhibits excellent travel distance and feel and is improved in scuff resistance and durability against repeated impact.

Therefore, in a first aspect, the present invention provides a multi-piece solid golf ball comprising a solid core, at least one intermediate layer enclosing the solid core, and a cover enclosing the intermediate layer, wherein the solid core is formed mainly of a base rubber containing an organosulfur compound, the intermediate layer is formed mainly of a base resin containing at least 50% by weight of a polyurethane elastomer, and the cover is formed mainly of a polyurethane elastomer. The intermediate layer and the cover have Shore D hardnesses that meet $0<[(\text{cover Shore D hardness})-(\text{intermediate layer Shore D hardness})]\leqq 20$. The total gage of the intermediate layer and the cover is up to 3.7 mm.

In a preferred embodiment, the solid core on its surface has a Shore D hardness of 40 to 58, the intermediate layer has a Shore D hardness of 40 to 55, and the cover has a Shore D hardness of 55 to 61. The polyurethane elastomer is preferably thermoplastic. The cover is preferably formed of a composition comprising, in admixture, the polyurethane elastomer and an isocyanate mixture of an isocyanate compound having at least two isocyanate groups as functional groups in a molecule, dispersed in a thermoplastic resin which is substantially non-reactive with the isocyanate groups.

The multi-piece solid golf ball of the first aspect is also improved in productivity because of no need for a primer to be applied between the intermediate layer and the cover.

It has also been found that in a multi-piece solid golf ball comprising a solid core, at least one intermediate layer and a cover, the second object is attained by forming the solid core from an organosulfur compound-containing base rubber, the intermediate layer from a polyurethane elastomer-containing base resin, and the cover from a polyurethane elastomer, and optimizing the hardness difference between the solid core and the intermediate layer and the hardness difference between the intermediate layer and the cover. The resulting golf ball travels a satisfactory distance, exhibits spin and trajectory properties comparable to the conventional three-piece golf balls, is improved in scuff resistance, durability against repeated impact and productivity. The ball is suited especially for practice.

Therefore, in a second aspect, the present invention provides a multi-piece solid golf ball comprising a solid core, at least one intermediate layer enclosing the solid core, and a cover enclosing the intermediate layer, wherein the solid core is formed mainly of a base rubber containing an organosulfur compound, the intermediate layer is formed mainly of a base resin containing at least 50% by weight of a polyurethane elastomer, and the cover is formed mainly of a polyurethane elastomer. The solid core on its surface and the intermediate layer have Shore D hardnesses that meet $0<[(\text{intermediate layer Shore D hardness})-(\text{solid core surface Shore D hardness})]\leqq 10$, and the intermediate layer and the cover have Shore D hardnesses that meet $0\leqq[(\text{intermediate layer Shore D hardness})-(\text{cover Shore D hardness})]\leqq 10$.

In a preferred embodiment, the solid core on its surface has a Shore D hardness of 45 to 58, the intermediate layer has a Shore D hardness of 55 to 60, and the cover has a Shore D hardness of 47 to 55. The polyurethane elastomer is preferably thermoplastic. The cover is preferably formed of a composition comprising, in admixture, the polyurethane elastomer and an isocyanate mixture of an isocyanate compound having at least two isocyanate groups as functional groups in a molecule, dispersed in a thermoplastic resin which is substantially non-reactive with the isocyanate groups.

DESCRIPTION OF THE PREFERRED EMBODIMENTS

In both the first and second aspects, the present invention provides a multi-piece solid golf ball comprising a solid core, at least one intermediate layer enclosing the solid core, and a cover enclosing the intermediate layer.

Solid Core

The solid core is formed of a rubber composition comprising primarily a base rubber containing an organosulfur compound.

Polybutadiene is preferably used as the base rubber. Polybutadienes customarily used in prior art solid golf balls are useful. The preferred polybutadiene is poly(cis-1,4-butadiene) having at least 40% of cis-structure. In the base rubber, the polybutadiene may be compounded with another rubber such as natural rubber, polyisoprene rubber or styrene-butadiene rubber.

In the rubber composition, unsaturated carboxylic acids and/or metal salts thereof, organic peroxides and inorganic fillers are compounded.

Illustrative examples of unsaturated carboxylic acids include acrylic acid, methacrylic acid, maleic acid and fumaric acid. Acrylic acid and methacrylic acid are especially preferred. Examples of the metal salts of unsaturated carboxylic acids include the zinc and magnesium salts of unsaturated fatty acids such as zinc methacrylate and zinc acrylate. Zinc acrylate is especially preferred.

The unsaturated carboxylic acids and/or metal salts thereof are generally used in an amount, per 100 parts of the base rubber, of at least 10 parts by weight, preferably at least 15 parts by weight, and most preferably at least 20 parts by weight, but not more than 60 parts by weight, preferably not more than 50 parts by weight, more preferably not more than 45 parts by weight, and most preferably not more than 40 parts by weight. Too much tends to give the golf ball a feel upon impact that is difficult to endure, whereas too little may diminish rebound characteristics.

Examples of inorganic fillers that may be used include zinc oxide, barium sulfate and calcium carbonate. The filler is generally included in an amount, per 100 parts by weight of the base rubber, of at least 5 parts by weight, preferably at least 7 parts by weight, and more preferably at least 10 parts by weight, but not more than 50 parts by weight, preferably not more than 40 parts by weight, more preferably not more than 30 parts by weight, and most preferably not more than 20 parts by weight. Too much or too little filler may make it impossible to achieve a golf ball having an appropriate weight and good rebound characteristics.

The organic peroxide may be a commercial product, suitable examples of which include Percumil D (manufactured by NOF Corporation), Perhexa 3M (manufactured by NOF Corporation) and Luperco 231XL (manufactured by Atochem Co.). Any one or combinations of two or more thereof may be used. The organic peroxide is generally included in an amount, per 100 parts by weight of the base rubber, of at least 0.1 part by weight, preferably at least 0.3 part by weight, more preferably at least 0.5 part by weight, and most preferably at least 0.7 part by weight, but not more than 5 parts by weight, preferably not more than 4 parts by weight, more preferably not more than 3 parts by weight, and most preferably not more than 2 parts by weight. Too much or too little organic peroxide may fail to achieve a ball having a good feel upon impact and good durability and rebound characteristics.

If necessary, the rubber composition may include also an antioxidant, suitable examples of which include such commercial products as Nocrac NS-6, Nocrac NS-30 (both made by Ouchi Shinko Chemical Industry Co., Ltd.), and Yoshinox 425 (made by Yoshitomi Pharmaceutical Industries, Ltd.). It is recommended that the antioxidant is included in an amount, per 100 parts by weight of the base rubber, of at least 0 part by weight, preferably at least 0.05 part by weight, more preferably at least 0.1 part by weight, and most preferably at least 0.2 part by weight, but not more than 3 parts by weight, preferably not more than 2 parts by weight, more preferably not more than 1 part by weight, and most preferably not more than 0.5 part by weight. Good rebound characteristics and durability are achievable with amounts of the antioxidant within this range.

The rubber composition should include an organosulfur compound. The organosulfur compound is effective for enhancing rebound characteristics. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and organosulfur compounds having 2 to 4 sulfur atoms, such as diphenylpolysulfides, dibenzylpolysulfides, dibenzoylpolysulfides, dibenzothiazoylpolysulfides and dithiobenzoylpolysulfides. Diphenyldisulfide and the zinc salt of pentachlorothiophenol are especially preferred. It is recommended that the organosulfur compound be included in an amount, per 100 parts by weight of the base rubber, of generally at least 0.05 part by weight, preferably at least 0.1 part by weight, and most preferably at least 0.2 part by weight, but generally not more than 5 parts by weight, preferably not more than 4 parts by weight, more preferably not more than 3 parts by weight, and most preferably not more than 2.5 parts by weight.

The solid core can be produced by subjecting the rubber composition containing the above constituents to vulcanization and curing by a known method. Typically, the rubber composition is worked with a mixing apparatus such as a Banbury mixer or a roll mill, then compression molded or injection molded in a core mold. The molded core is then cured by appropriate heating at a temperature sufficient for the crosslinking agent and the co-crosslinking agent to act. When dicumyl peroxide is used as the crosslinking agent and zinc acrylate is used as the co-crosslinking agent, heating is generally carried out at about 130 to 170° C., and preferably 150 to 160° C., for about 10 to 40 minutes, and preferably 12 to 20 minutes.

In the first embodiment of the invention, the solid core on its surface preferably has a Shore D hardness of at least 40, more preferably at least 43, and up to 58, more preferably up to 55. In the second embodiment of the invention, the solid core on its surface preferably has a Shore D hardness of at least 45, more preferably at least 48, and up to 58, more preferably up to 55. The surface hardness (in Shore D hardness units) of the solid core can be set within the above range by suitably selecting, for example, the types and amounts of materials formulated in the solid core, the types and amounts of crosslinking agent and co-crosslinking agent included, and the vulcanizing conditions. At a solid core surface hardness below the above range, the ball may have too soft a feel upon impact and diminished rebound characteristics, resulting in a poor distance. If the surface hardness is too high, the ball may have too lively a feel and a tendency to describe a high arc in flight.

The solid core may be given a construction composed of a single layer or a plurality of layers. When a solid core having a plurality of layers is used, the solid core surface hardness, as used herein, refers to the surface hardness of the outermost layer of the solid core.

The solid core has a diameter of preferably at least 35 mm, and most preferably at least 36 mm, but preferably up to 40 mm, and most preferably up to 39 mm. The solid core has a weight of preferably 27 to 37 g, and most preferably 30 to 35 g in the first embodiment, and a weight of preferably 25 to 32 g, and most preferably 27 to 30 g in the second embodiment.

Intermediate Layer

In the ball of the invention, the intermediate layer is disposed to concentrically enclose the solid core and formed mainly of a base resin containing at least 50% by weight of a polyurethane elastomer.

The base resin contains at least 50% by weight, preferably at least 70% by weight, more preferably at least 90% by weight, most preferably 100% by weight of a polyurethane elastomer, preferably thermoplastic polyurethane elastomer. If desired, a component other than polyurethane elastomer is added, for example, an ionomer resin or elastomers other than the polyurethane elastomer. If the content of polyurethane elastomer in the base resin is less than 50% by weight, the intermediate layer becomes less adhesive to the overlaying cover, resulting in an early decline of rebound upon repeated impact.

The molecular structure of the polyurethane elastomer is generally made up of polymeric polyols as the soft segments, and monomolecular chain extenders and diisocyanates as the hard segments.

Any polymeric polyol may be used. Examples include polyester polyols and polyether polyols of these, polyether polyols are preferred to polyester polyols for the preparation of polyurethane elastomers having excellent impact resilience and low-temperature properties. Suitable examples of polyether polyols include polytetramethylene glycol and polypropylene glycol, with the polytetramethylene glycol being most preferred. Their number average molecular weight is about 1,000 to 5,000, preferably about 2,000 to 4,000.

Any diisocyanate may be used. Illustrative examples include aromatic diisocyanates such as 4,4'-diphenylmethane diisocyanate, 2,4-toluene diisocyanate, and 2,6-toluene diisocyanate; and aliphatic diisocyanate such as hexamethylene diisocyanate. When an isocyanate compound is used in the preparation of elastomers, it is recommended to use 4,4'-diphenylmethane diisocyanate as the diisocyanate because of its reactivity with the isocyanate compound.

The monomolecular chain extender used herein is not critical and use may be made of ordinary polyhydric alcohols and amines. Specific examples include 1,4-butylene glycol, 1,2-ethylene glycol, 1,3-propylene glycol, 1,3-butanediol, 1,6-hexylene glycol, 2,2-dimethyl-1,3-propanediol, 1,3-butylene glycol, dicyclohexylmethylmethanediamine (hydrogenated MDA) and isophoronediamine (IPDA). These chain extenders preferably have an average molecular weight of about 20 to 15,000.

The polyurethane elastomers described above may be commercial products. Illustrative examples include Pandex T7890, T7298, TR3080, T8290, T8295 and T8260 (all manufactured by DIC Bayer Polymer, Ltd.), and Resamine 2593 and 2597 (manufactured by Dainichiseika Color & Chemicals Mfg. Co., Ltd.).

Ionomer resins which can be added to the polyurethane elastomer include olefin-unsaturated carboxylic acid binary random copolymers, olefin-unsaturated carboxylic acid-unsaturated carboxylate ternary random copolymers, and metal ion neutralized products thereof. Commercially available ionomer resins are useful. For example, binary random copolymers are commercially available under the trade name of Nucrel 1560, 1214 and 1035 from DuPont-Mitsui Polychemicals Co., Ltd. and ESCOR 5200, 5100 and 5000 from EXXONMOBIL Chemical; ternary random copolymers are commercially available under the trade name of Nucrel AN4311 and AN4318 from DuPont-Mitsui Polychemicals Co., Ltd. and ESCOR ATX325, ATX320 and ATX310 from EXXONMOBIL Chemical; metal ion-neutralized binary random copolymers are commercially available under the trade name of Himilan 1554, 1557, 1601, 1605, 1706 and AM7311 from DuPont-Mitsui Polychemicals Co., Ltd., Surlyn 7930 from E. I. Dupont, and Iotek 3110 and 4200 from EXXONMOBIL Chemical; and metal ion-neutralized ternary random copolymers are commercially available under the trade name of Himilan 1855, 1856, and AM7316 from DuPont-Mitsui Polychemicals Co., Ltd., Surlyn 6320, 8320, 9320 and 8120 from E. I. Dupont, and Iotek 7510 and 7520 from EXXONMOBIL Chemical.

Elastomers (other than polyurethane) which can be added to the polyurethane elastomer include, but are not limited to, polyolefin elastomers, polystyrene elastomers, polyester elastomers, and polyamide elastomers. These elastomers are preferably thermoplastic. Of these, polyolefin elastomers and polyester elastomers are preferred because further enhancement of restitution is expectable. Such elastomers are commercially available, for example, Dynalon (JSR Corp.) as polyolefin elastomers and Hytrel (Dupont-Toray Co., Ltd.) as polyester elastomers.

If necessary, various additives are added to the base resin. Examples of such additives include pigments, dispersants, antioxidants, ultraviolet absorbers, light stabilizers, and inorganic fillers (e.g., zinc oxide, barium sulfate, titanium dioxide). The intermediate layer can be formed by adding such additives to the base resin, if necessary, and molding the base resin around the solid core by any well-known method, typically injection molding method.

In the first embodiment of the invention, the intermediate layer preferably has a Shore D hardness of at least 40, more preferably at least 42, and up to 55, more preferably up to 50. In the second embodiment of the invention, the intermediate layer preferably has a Shore D hardness of at least 55, more preferably at least 56, and up to 60, more preferably up to 59. The hardness (in Shore D hardness units) of the intermediate layer can be set within the above range by suitably selecting, for example, the types and amounts of materials formulated in the intermediate layer and the molding conditions. Too low an intermediate layer hardness may lead to reduced durability against repeated impact, increased spin rate and poor rebound characteristics, resulting in a shorter flight distance. On the other hand, an intermediate layer hardness that is too high may compromise the feel and scuff resistance.

Cover

In the ball of the invention, the cover is disposed to concentrically enclose the intermediate layer and formed mainly of a polyurethane elastomer.

The polyurethane elastomers used herein include those exemplified as the polyurethane elastomer in the intermediate layer, and preferably thermoplastic ones.

Such thermoplastic polyurethane elastomers are commercially available under the trade name of Pandex T7890, T7298, TR3080, T8290, T8295 and T8260 from DIC Bayer Polymer, Ltd. and Resamine 2593 and 2597 from Dainichiseika Color & Chemicals Mfg. Co., Ltd.

In a preferred embodiment, the cover is made of a composition comprising the above-mentioned thermoplastic polyurethane and an isocyanate mixture because the cover is improved in cut resistance and scuff resistance over the cover formed mainly of the polyurethane elastomer alone.

The isocyanate mixture used herein is a mixture of (i) a compound having as functional groups at least two isocyanate groups per molecule and (ii) a thermoplastic resin that is substantially non-reactive with the isocyanate groups, with the isocyanate compound (i) dispersed in the thermoplastic resin (ii).

The compound having as functional groups at least two isocyanate groups per molecule which serves as component (i) may be an isocyanate compound used in the prior art relating to polyurethanes, such as an aromatic isocyanate compound, a hydrogenated aromatic isocyanate compound, an aliphatic diisocyanate or an alicyclic diisocyanate. Suitable aromatic isocyanate compounds include 2,4-toluene diisocyanate, 2,6-toluene diisocyanate, mixtures of 2,4-toluene diisocyanate with 2,6-toluene diisocyanate, 4,4'-diphenylmethane diisocyanate, m-phenylene diisocyanate and 4,4'-diphenyl diisocyanate. Suitable hydrogenated aromatic isocyanate compounds include dicyclohexylmethane diisocyanate. Suitable aliphatic diisocyanates include tetramethylene diisocyanate, hexamethylene diisocyanate (HDI) and octamethylene diisocyanate. A suitable alicyclic diisocyanate is xylylene diisocyanate.

The isocyanate mixture is generally included in an amount, per 100 parts by weight of the polyurethane elastomer, of at least 1 part by weight, preferably at least 5 parts by weight, and most preferably at least 8 parts by weight, and up to 50 parts by weight, preferably up to 30 parts by weight, and most preferably up to 20 parts by weight. Too little isocyanate mixture may fail to achieve a sufficient crosslinking reaction or to enhance physical properties. On the other hand, too much may result in greater discoloration over time or due to the effects of heat and ultraviolet light, and may also have other undesirable effects, such as lowering resilience.

If necessary, various additives are added to the polyurethane composition for the cover. Examples of such additives include pigments, dispersants, antioxidants, ultraviolet absorbers, ultraviolet stabilizers, and plasticizers. The cover can be formed by adding such additives to the polyurethane composition, if necessary, and molding the composition around the intermediate layer by any well-known method, typically injection molding method.

In the first embodiment of the invention, the cover preferably has a Shore D hardness of at least 55, more preferably at least 56, and up to 61, more preferably up to 60. In the second embodiment of the invention, the cover preferably has a Shore D hardness of at least 47, more preferably at least 50, and up to 55, more preferably up to 54. The hardness (in Shore D hardness units) of the cover can be set within the above range by suitably selecting, for example, the types and amounts of materials formulated in the cover and the molding conditions. A cover hardness below the range may lead to an increased spin rate and reduced rebound, especially on shots with a driver (W#1), resulting in a poor flight distance. A cover hardness beyond the range may compromise scuff resistance and durability against repeated impact.

If desired, an adhesive layer may intervene between the intermediate layer and the cover for the purpose of improving durability to impact. However, the provision of such an adhesive layer is unnecessary when the intermediate layer and the cover are formed of materials which tightly bond with each other as is often the case in the present invention. The adhesive, if used herein, is not critical. Epoxy resin adhesives, vinyl resin adhesives and rubber adhesives are useful, although urethane resin adhesives and chlorinated polyolefin adhesives are preferred. Commercial products are available as the adhesive. An exemplary urethane resin adhesive is Resamine D6208 (made by Dainichiseika Color & Chemicals Mfg. Co., Ltd.) and an exemplary chlorinated polyolefin adhesive is RB182 Primer (made by Nippon Bee Chemical Co., Ltd.).

Dispersion coating may be used to form the adhesive layer. The type of emulsion which is used in dispersion coating is not critical. The resin powder used in preparing the emulsion may be either thermoplastic resin powder or thermosetting resin powder. Exemplary resins are vinyl acetate resins, vinyl acetate copolymer resins, EVA (ethylene-vinyl acetate copolymer resins), acrylate (co)polymer resins, epoxy resins, thermosetting urethane resins, and thermoplastic urethane resins. Of these, epoxy resins, thermosetting urethane resins, thermoplastic urethane resins, and acrylate (co)polymer resins are preferred, with the thermoplastic urethane resins being most appropriate.

Preferably the adhesive layer has a gage of at least 0.1 μm, especially at least 0.2 μm and up to 30 μm, especially up to 25 μm.

Hardness Difference

The invention controls the difference between the Shore D hardnesses of two adjoining layers within an appropriate range.

In the first embodiment, the Shore D hardness of the intermediate layer and the Shore D hardness of the cover are adjusted to meet: 0<[(cover Shore D hardness)−(intermediate layer Shore D hardness)]≦20, and preferably 5≦[(cover Shore D hardness)−(intermediate layer Shore D hardness)]≦15. A hardness difference beyond the range may compromise durability against repeated impact whereas a hardness difference below the range may compromise feel on impact.

In the first embodiment, the Shore D hardness of the solid core surface and the Shore D hardness of the intermediate layer are preferably adjusted to meet: −10≦[(intermediate layer Shore D hardness)−(solid core surface Shore D hardness)]≦10, especially −5≦[(intermediate layer Shore D hardness)−(solid core surface Shore D hardness)]≦5. If this hardness difference is beyond the range, the feel on impact, especially with an iron, may become poor. A hardness difference below the range may cause reduced rebound and increased spin, resulting in shortage of flight distance.

In the second embodiment, the Shore D hardness of the solid core on its surface and the Shore D hardness of the intermediate layer are adjusted to meet: 0<[(intermediate layer Shore D hardness)−(solid core surface Shore D hardness)]≦10, especially 2≦[(intermediate layer Shore D hardness)−(solid core surface Shore D hardness)]≦8. A hardness difference beyond the range suggests that the solid core is relatively soft and may invite poor rebound resulting in a reduced distance, and poor bond between the intermediate layer and the solid core, leading to an early decline of rebound upon repeated impact. A hardness difference below the range suggests that the intermediate layer is relatively soft and may invite too much spin and poor rebound resulting in a reduced distance.

Also in the second embodiment, the Shore D hardness of the intermediate layer and the Shore D hardness of the cover are adjusted to meet: 0<[(intermediate layer Shore D hardness)−(cover Shore D hardness)]≦10, especially 2≦[(intermediate layer Shore D hardness)−(cover Shore D hardness)]≦8. A hardness difference beyond the range suggests that the cover is relatively soft and may invite too much spin, resulting in a reduced distance, and poor bond between the intermediate layer and the cover, leading to an early decline of rebound upon repeated impact. A hardness difference below the range suggests that the intermediate layer is relatively soft and may invite too much spin and poor rebound resulting in a reduced distance.

In the second embodiment, a tight bond is established between the intermediate layer and the cover, eliminating a need for an adhesive layer between the intermediate layer and the cover as in prior art multi-piece balls. Removing the step of applying a primer to the intermediate layer after its formation contributes to an improvement in productivity.

It is noted that the intermediate layer may consist of a single layer or a plurality of layers. Where the intermediate layer consists of a plurality of layers, each layer should meet the hardness requirement defined above.

In the first embodiment, the total gage of the intermediate layer and the cover is up to 3.7 mm, preferably 1.5 mm to 3.2 mm and more preferably 1.9 mm to 2.7 mm. With a total gage beyond the range, the ball becomes less rebound, resulting in distance shortage. Preferably the intermediate layer has a gage of at least 0.5 mm, more preferably at least 0.9 mm and up to 1.8 mm, more preferably up to 1.3 mm. Also preferably, the cover has a gage of at least 0.6 mm, more preferably at least 1 mm and up to 1.5 mm, more preferably up to 1.3 mm.

In the second embodiment, the intermediate layer preferably has a gage of at least 1.0 mm, more preferably at least 1.4 mm and up to 2.2 mm, more preferably up to 1.8 mm; and the cover preferably has a gage of at least 0.9 mm, more preferably at least 1.3 mm and up to 2.1 mm, more preferably up to 1.7 mm.

The golf ball of the invention should comply with the Rules of Golf. The ball is typically formed to a diameter of not less than 42.67 mm and a weight of not greater than 45.93 g. Preferably, the ball diameter is 42.67 to 42.90 mm, especially 42.70 to 42.80 mm. The ball weight is preferably 44.9 to 45.93 g, especially 45.2 to 45.6 g.

In the first embodiment of the invention, a multi-piece solid golf ball is improved in flight distance, feel, scuff resistance and durability against repeated impact.

In the second embodiment of the invention, a multi-piece solid golf ball is improved in travel distance over one-piece balls, comparable in spin and trajectory with conventional three-piece golf balls having a thermoplastic polyurethane elastomer cover professional and skilled golfers use on the course, improved in scuff resistance and durability against repeated impact, and good in productivity because the invention eliminates a need for a primer to be applied between the intermediate layer and the cover and a need of preforming the cover.

EXAMPLE

Examples of the invention and comparative examples are given below by way of illustration and not be way of limitation.

Examples 1–3 & Comparative Examples 1–7

Solid cores were prepared by using core materials of the composition shown in Table 1 based on polybutadiene (BR11 and BR18, both by JSR Corp.), molding them and vulcanizing at a temperature of 157° C. for 15 minutes. Physical properties of the solid cores were measured, with the results shown in Table 1.

Next, materials of the composition shown in Table 3 were injection molded around the solid cores to form intermediate layers, physical properties of which were measured. Further, materials of the composition shown in Table 3 were injection molded around the intermediate layers to form covers, completing golf balls, physical properties of which were measured. The results of measurement are shown in Table 2.

TABLE 1

| | Example | | | Comparative Example | | | | | | |
|---|---|---|---|---|---|---|---|---|---|---|
| | 1 | 2 | 3 | 1 | 2 | 3 | 4 | 5 | 6 | 7 |
| Solid core composition (pbw) | | | | | | | | | | |
| Polybutadiene BR11 | 50 | 50 | 50 | 50 | 50 | 50 | 50 | 50 | 50 | 50 |
| Polybutadiene BR18 | 50 | 50 | 50 | 50 | 50 | 50 | 50 | 50 | 50 | 50 |
| Zinc acrylate | 28.5 | 27.7 | 26.1 | 27.7 | 26.1 | 27.7 | 27.7 | 24.6 | 27.7 | 27.7 |
| Peroxide 1*[1] | 0.6 | 0.6 | 0.6 | 0.6 | 0.6 | 0.6 | 0.6 | 0.6 | 0.6 | 0.6 |
| Peroxide 2*[2] | 0.6 | 0.6 | 0.6 | 0.6 | 0.6 | 0.6 | 0.6 | 0.6 | 0.6 | 0.6 |
| Antioxidant*[3] | 0.2 | 0.2 | 0.2 | 0.2 | 0.2 | 0.2 | 0.2 | 0.2 | 0.2 | 0.2 |
| Zinc oxide | 10.8 | 11.5 | 11.9 | 16.4 | 12.7 | 16.4 | 12.3 | 12.5 | 9.3 | 14.5 |
| Zinc salt of pentachlorothiophenol | 1 | 1 | 1 | 1 | 1 | 1 | 1 | 0 | 1 | 1 |
| Zinc stearate | 5 | 5 | 5 | 5 | 5 | 5 | 5 | 0 | 5 | 5 |
| Core physical properties | | | | | | | | | | |
| Outer diameter (mm) | 38.50 | 38.50 | 38.60 | 38.40 | 38.70 | 38.50 | 38.50 | 38.40 | 35.00 | 38.50 |
| Weight (g) | 33.02 | 33.07 | 33.29 | 33.68 | 33.68 | 33.94 | 33.23 | 32.75 | 24.57 | 33.61 |
| Surface hardness (Shore D)*[4] | 49 | 48 | 46 | 48 | 46 | 48 | 48 | 49 | 48 | 48 |

*[1]Percumil D (dicumyl peroxide), NOF Corp.

*[2]Perhexa 3M-40 (1,1-bis(t-butylperoxy)-3,3,5-trimethylcyclohexane), NOF Corp.

*[3]Nocrac NS-6, Ouchi Shinko Chemical Industry Co., Ltd.

*[4]The surface hardness of the solid core was measured according to ASTM D-2240.

TABLE 2

| | Example | | | Comparative Example | | | | | | |
|---|---|---|---|---|---|---|---|---|---|---|
| | 1 | 2 | 3 | 1 | 2 | 3 | 4 | 5 | 6 | 7 |
| Intermediate layer | | | | | | | | | | |
| Composition (see Table 3) | ① | ② | ③ | ④ | ⑤ | ① | ⑥ | ① | ② | ⑦ |
| Outer diameter of a sphere of core/intermediate layer (mm) | 40.50 | 40.50 | 40.50 | 40.40 | 40.50 | 40.50 | 40.50 | 40.50 | 38.70 | 40.50 |
| Gage (mm) | 1.00 | 1.00 | 0.95 | 1.00 | 0.90 | 1.00 | 1.00 | 1.05 | 1.85 | 1.00 |
| Specific gravity ($g/cm^3$) | 1.16 | 1.15 | 1.16 | 0.97 | 1.13 | 1.16 | 1.14 | 1.16 | 1.15 | 1.15 |
| Sheet hardness*[5] (Shore D) | 47 | 45 | 50 | 47 | 43 | 47 | 58 | 47 | 45 | 40 |
| Cover | | | | | | | | | | |
| Composition (see Table 3) | ⑥ | ⑥ | ⑥ | ⑥ | ⑥ | ⑧ | ⑨ | ⑥ | ⑥ | ⑩ |
| Ball outer diameter (mm) | 42.7 | 42.7 | 42.7 | 42.7 | 42.7 | 42.7 | 42.7 | 42.7 | 42.7 | 42.7 |
| Gage (mm) | 1.10 | 1.10 | 1.10 | 1.15 | 1.10 | 1.10 | 1.10 | 1.10 | 2.00 | 1.10 |
| Ball weight (g) | 45.40 | 45.40 | 45.40 | 45.40 | 45.40 | 45.40 | 45.40 | 45.40 | 45.40 | 45.40 |
| Specific gravity ($g/cm^3$) | 1.14 | 1.14 | 1.14 | 1.14 | 1.14 | 0.98 | 1.12 | 1.14 | 1.14 | 1.05 |
| Sheet hardness*[6] (Shore D) | 58 | 58 | 58 | 58 | 58 | 59 | 47 | 58 | 58 | 62 |

*[5]The material for the intermediate layer was injection molded into a sheet of 2 mm thick under the same temperature condition as used when the intermediate layer was molded around the solid core. After holding for about 2 weeks, the sheet was measured for hardness according to ASTM D-2240.

*[6]The material for the cover was injection molded into a sheet of 2 mm thick under the same temperature condition as used when the cover was molded around the intermediate layer. After holding for about 2 weeks, the sheet was measured for hardness according to ASTM D-2240.

Note that the outer diameter of a sphere is the outer diameter of a sphere obtained by enclosing the core with the intermediate layer.

TABLE 3

| | Composition (pbw) | | | | | | | | | |
|---|---|---|---|---|---|---|---|---|---|---|
| | ① | ② | ③ | ④ | ⑤ | ⑥ | ⑦ | ⑧ | ⑨ | ⑩ |
| Himilan 1557 | | | | 15 | | | | 50 | | |
| Himilan 1856 | | | | | | | | 50 | | |
| Surlyn 8120 | | | | 85 | | | | | | |
| AM7315 | | | | | | | | | | 50 |
| Hytrel 4047 | | | | | 100 | | | | | |
| Pandex T7890 | | | | | | | 100 | | | |
| Pandex T7298 | 75 | 50 | 100 | | | | | | | |
| Pandex TR3080 | 25 | 50 | | | | | | | | |
| Pandex T8295 | | | | | | | | | 50 | |
| Pandex T8290 | | | | | | | | | 50 | |
| Pandex T8260 | | | | | | 100 | | | | 50 |
| Isocyanate mixture 1 | 1.5 | 1.5 | 1.5 | | | | 1.5 | | | |
| Titanium dioxide | 4 | 4 | 4 | 2.5 | | 4 | 4 | 5 | 4 | 4 |
| Polyethylene wax | 1.5 | 1.5 | 1.5 | | | 1.5 | 1.5 | | 1.5 | 1.5 |
| Isocyanate mixture 2 | | | | | | 10 | | | 10 | 10 |

Note that the trade names and materials in Tables have the following meanings.

"Himilan" series: ionomer resins by Dupont-Mitsui Polychemicals Co., Ltd.

"Surlyn" series: ionomer resins by DuPont

AM7315: Zn ionomer resin with acid content 20%, by Dupont-Mitsui Polychemicals Co., Ltd.

"Hytrel" series: thermoplastic polyester elastomers by DuPont-Toray Co., Ltd.

"Pandex" series: thermoplastic polyurethane elastomers by DIC-Bayer Polymer Ltd.

Isocyanate mixture 1: trade name Cronate EM30, made by Dainichiseika Color & Chemicals Mfg. Co., Ltd. Contains 30 wt % 4,4'-diphenylmethane diisocyanate (isocyanate concentration as determined by amine back titration according to JIS K1556: 5–10%). The master batch base resin was a polyester elastomer. On use, isocyanate mixture 1 was milled with the remaining cover components at the same time as injection molding.

Isocyanate mixture 2: trade name Desmodur W, made by ACI Japan Co., Ltd. hydrogenated MDI. dicyclohexylmethane- 4,4'-diisocyanate. On use, isocyanate mixture 2 was milled in an extruder prior to injection molding.

The golf balls were hit for evaluating various properties, with the results shown in Table 4.

TABLE 4

| | | Example | | | Comparative Example | | | | | | |
|---|---|---|---|---|---|---|---|---|---|---|---|
| | | 1 | 2 | 3 | 1 | 2 | 3 | 4 | 5 | 6 | 7 |
| Hardness difference [cover - intermediate layer] (Shore D) | | 11 | 13 | 8 | 11 | 15 | 12 | −11 | 11 | 13 | 22 |
| Hardness difference [intermediate layer - core] (Shore D) | | −2 | −3 | 4 | −1 | −3 | −1 | 10 | −2 | −3 | −8 |
| Total gage of intermediate layer + cover (mm) | | 2.10 | 2.10 | 2.05 | 2.15 | 2.00 | 2.10 | 2.10 | 2.15 | 3.85 | 2.10 |
| | | Ball tests | | | | | | | | | |
| Flight | Carry (m) | 187.1 | 186.5 | 185.2 | 185.8 | 188.0 | 189.2 | 183.5 | 182.7 | 182.2 | 186.0 |
| | Total (m) | 197.5 | 196.4 | 198.2 | 197.0 | 201.1 | 202.5 | 193.8 | 194.1 | 192.1 | 198.3 |
| | Spin (rpm) | 2900 | 2885 | 2801 | 2873 | 2843 | 2843 | 3137 | 2900 | 2885 | 2795 |
| | Rating | ○ | ○ | ○ | ○ | ○ | ○ | x | x | x | ○ |
| Feel | W#1 | ○ | ○ | ○ | ○ | ○ | ○ | ○ | ○ | ○ | ○ |
| | I#9 | ○ | ○ | ○ | ○ | ○ | ○ | x | ○ | ○ | ○ |
| Durability to repeated impact | | ○ | ○ | ○ | x | x | x | ○ | ○ | ○ | x |
| Scuff resistance | | ○ | ○ | ○ | ○ | ○ | x | ○ | ○ | ○ | x |

The test methods and the evaluation criteria are shown below.

Flight

Each ball was struck with a driver (W#1) at a head speed (HS) of 40 m/s. The spin rate, carry and total distance of the ball were measured. The driver used was a Tour Stage X500 (loft angle 10°) by Bridgestone Sports Co., Ltd. A ball with a total distance of at least 195 m was rated as good "O" and a total distance of less than 195 m as poor "X."

Feel

Each ball was actually shot with a driver (W#1) and iron No. 9 (I#9) by ten average golfers having a head speed of about 40 m/s. The feel of the ball was rated as: good "O" when at least 7 of the 10 golfers thought the feel was good; and poor "X" when 3 or fewer of the 10 golfers thought the feel was good.

Durability to Repeated Impact

Each ball was repeatedly struck with a driver (W#1) at a head speed of 40 m/s. The number of strikes required to produce a consecutive decline of 3% in the ball rebound was counted. A relative index was computed based on a value of 100 for the number of catastrophic strikes to the golf ball of Example 2. The ball was rated as: good "O" when the index was at least 95; and poor "X" when the index was less than 90.

Scuff Resistance

Each ball was struck once with a pitching wedge (PW) having angular grooves at a head speed of 45 m/s. The surface of the ball was observed. The ball was rated as: good "O" when usable again, and poor "X" when no longer usable because of the damaged ball surface.

As seen from Table 4, the golf balls within the first embodiment of the invention are good in flight performance and feel and non-defective with respect to durability to repeated impact and scuff resistance, offering excellent overall ball properties. In contrast the golf balls of Comparative Examples 1 to 7 are poor in one or more of flight distance, feel, durability to repeated impact and scuff resistance, and fail to offer excellent overall ball properties.

The performance of the golf balls of Comparative Examples 1 to 7 is discussed in more detail.

Comparative Example 1, in which the intermediate layer is made of an ionomer resin and less adherent to the cover, is less durable to repeated impact.

Comparative Example 2, in which the intermediate layer is made of a polyester elastomer and less adherent to the cover, is less durable to repeated impact.

Comparative Example 3, in which the cover is made of an ionomer resin and less adherent to the intermediate layer, is less durable to repeated impact and less resistant to scuffing.

Comparative Example 4, in which the cover is softer than the intermediate layer, travels short due to too much spin and gives a poor feel when hit with I#9.

Comparative Example 5, in which the core is free of an organosulfur compound, is less rebound and travels short.

Comparative Example 6, in which the total gage of the intermediate layer and the cover is greater than 3.7 mm, is less rebound and travels short.

Comparative Example 7, in which the hardness difference between the intermediate layer and the cover, [(cover hardness)−(intermediate layer hardness)], is more than 20, is less durable to repeated impact and less resistant to scuffing.

Examples 4–6 & Comparative Examples 8–16

In Examples 4 to 6 and Comparative Examples 8 to 14, solid cores were prepared by using core materials of the composition shown in Table 5 based on polybutadiene (BR11 and BR18, both by JSR Corp.), molding them and vulcanizing at a temperature of 157° C. for 15 minutes. Physical properties of the solid cores were measured, with the results shown in Table 5.

Next, materials of the composition shown in Table 7 were injection molded around the solid cores to form intermediate layers, physical properties of which were measured. Further, materials of the composition shown in Table 7 were injection molded around the intermediate layers to form covers, completing golf balls, physical properties of which were measured. The results of measurement are shown in Table 6.

TABLE 5

| | Example | | | Comparative Example | | | | | | |
|---|---|---|---|---|---|---|---|---|---|---|
| | 4 | 5 | 6 | 8 | 9 | 10 | 11 | 12 | 13 | 14 |
| | Solid core composition (pbw) | | | | | | | | | |
| Polybutadiene BR11 | 50 | 50 | 50 | 50 | 50 | 50 | 50 | 50 | 50 | 50 |
| Polybutadiene BR18 | 50 | 50 | 50 | 50 | 50 | 50 | 50 | 50 | 50 | 50 |
| Zinc acrylate | 30.1 | 31.7 | 30.1 | 31.7 | 29.3 | 31.7 | 34.1 | 30.1 | 26.1 | 26.2 |
| Peroxide 1*[1] | 0.6 | 0.6 | 0.6 | 0.6 | 0.6 | 0.6 | 0.6 | 0.6 | 0.6 | 0.6 |
| Peroxide 2*[2] | 0.6 | 0.6 | 0.6 | 0.6 | 0.6 | 0.6 | 0.6 | 0.6 | 0.6 | 0.6 |
| Antioxidant*[3] | 0.2 | 0.2 | 0.2 | 0.2 | 0.2 | 0.2 | 0.2 | 0.2 | 0.2 | 0.2 |
| Zinc oxide | 10.4 | 9.5 | 10.7 | 17.9 | 19.3 | 10.7 | 9.1 | 10.7 | 12.2 | 12.4 |
| Zinc salt of pentachlorothiophenol | 1 | 1 | 1 | 1 | 1 | 1 | 1 | 1 | 1 | 0 |
| Zinc stearate | 5 | 5 | 5 | 5 | 5 | 5 | 5 | 5 | 5 | 0 |

TABLE 5-continued

| | Example | | | Comparative Example | | | | | | |
|---|---|---|---|---|---|---|---|---|---|---|
| | 4 | 5 | 6 | 8 | 9 | 10 | 11 | 12 | 13 | 14 |
| | Core physical properties | | | | | | | | | |
| Outer diameter (mm) | 36.40 | 36.40 | 36.70 | 36.40 | 36.20 | 36.40 | 36.40 | 36.40 | 36.40 | 36.90 |
| Weight (g) | 27.96 | 27.92 | 28.70 | 29.16 | 28.75 | 28.11 | 28.03 | 28.00 | 27.96 | 29.15 |
| Surface hardness (Shore D)*4 | 51 | 54 | 51 | 54 | 50 | 54 | 57 | 51 | 46 | 51 |

*1Percumil D (dicumyl peroxide), NOF Corp.

*2Perhexa 3M-40 (1,1-bis(t-butylperoxy)-3,3,5-trimethylcyclohexane), NOF Corp.

*3Nocrac NS-6, Ouchi Shinko Chemical Industry Co., Ltd.

*4The surface hardness of the solid core was measured according to ASTM D-2240.

TABLE 6

| | Example | | | Comparative Example | | | | | | |
|---|---|---|---|---|---|---|---|---|---|---|
| | 4 | 5 | 6 | 8 | 9 | 10 | 11 | 12 | 13 | 14 |
| | Intermediate layer | | | | | | | | | |
| Composition (see Table 7) | ④ | ④ | ④ | ④ | ⑦ | ① | ③ | ④ | ④ | ④ |
| Outer diameter of a sphere of core/intermediate layer (mm) | 39.70 | 39.70 | 40.00 | 39.70 | 39.70 | 39.90 | 39.70 | 39.70 | 39.70 | 39.90 |
| Gage (mm) | 1.65 | 1.65 | 1.65 | 1.65 | 1.75 | 1.75 | 1.65 | 1.65 | 1.65 | 1.50 |
| Specific gravity (g/cm$^3$) | 1.14 | 1.14 | 1.14 | 1.14 | 0.98 | 1.12 | 1.13 | 1.14 | 1.14 | 1.14 |
| Sheet hardness*5 (Shore D) | 58 | 58 | 58 | 58 | 59 | 47 | 54 | 58 | 58 | 58 |
| Adhesive between intermediate layer and cover | no | no | no | no | no | no | no | no | no | no |
| | Cover | | | | | | | | | |
| Composition (see Table 7) | ② | ③ | ⑤ | ⑥ | ② | ② | ② | ① | ② | ② |
| Ball outer diameter (mm) | 42.7 | 42.7 | 42.7 | 42.7 | 42.7 | 42.7 | 42.7 | 42.7 | 42.7 | 42.7 |
| Gage (mm) | 1.50 | 1.50 | 1.35 | 1.50 | 1.50 | 1.40 | 1.50 | 1.50 | 1.50 | 1.40 |
| Ball weight (g) | 45.4 | 45.4 | 45.4 | 45.4 | 45.4 | 45.4 | 45.4 | 45.4 | 45.4 | 45.4 |
| Specific gravity (g/cm$^3$) | 1.13 | 1.13 | 1.13 | 0.97 | 1.13 | 1.13 | 1.13 | 1.12 | 1.13 | 1.13 |
| Sheet hardness*6 (Shore D) | 51 | 54 | 52 | 53 | 51 | 54 | 51 | 47 | 51 | 51 |
| Hardness difference [intermediate layer - core surface] (Shore D) | 7 | 4 | 7 | 4 | 9 | −7 | −3 | 7 | 12 | 7 |
| Hardness difference [intermediate layer - cover] (Shore D) | 7 | 4 | 6 | 5 | 8 | −7 | 3 | 11 | 7 | 7 |

*5The material for the intermediate layer was injection molded into a sheet of 2 mm thick under the same temperature condition as used when the intermediate layer was molded around the solid core. After holding for about 2 weeks, the sheet was measured for hardness according to ASTM D-2240.

*6The material for the cover was injection molded into a sheet of 2 mm thick under the same temperature condition as used when the cover was molded around the intermediate layer. After holding for about 2 weeks, the sheet was measured for hardness according to ASTM D-2240. Note that the outer diameter of a sphere is the outer diameter of a sphere obtained by enclosing the core with the intermediate layer.

TABLE 7

| | Composition (pbw) | | | | | | |
|---|---|---|---|---|---|---|---|
| | ① | ② | ③ | ④ | ⑤ | ⑥ | ⑦ |
| Himilan 1557 | | | | | | 20 | 50 |
| Himilan 1855 | | | | | | 30 | |
| Himilan 1856 | | | | | | | 50 |
| Surlyn 8120 | | | | | | 50 | |
| Pandex T8295 | 50 | 100 | 50 | | 25 | | |
| Pandex T8290 | 50 | | | | 25 | | |
| Pandex T8260 | | | 50 | 100 | 50 | | |
| Titanium dioxide | 4 | 4 | 4 | 4 | 4 | 5 | 5 |
| Polyethylene wax | 1.5 | 1.5 | 1.5 | 1.5 | 1.5 | | |
| Isocyanate mixture | 10 | 10 | 10 | 10 | 10 | | |

Note that the trade names and materials in Tables have the following meanings.
"Himilan" series: ionomer resins by Dupont-Mitsui Polychemicals Co., Ltd.
"Surlyn" series: ionomer resins by DuPont
"Pandex" series: thermoplastic polyurethane elastomers by DIC-Bayer Polymer Ltd.
Isocyanate mixture: trade name Cronate EM30, made by Dainichiseika Color & Chemicals Mfg. Co., Ltd. Contains 30 wt % 4,4'-diphenylmethane diisocyanate (isocyanate concentration as determined by amine back titration according to JIS K1556: 5–10%). The master batch base resin was a polyester elastomer. On use, the isocyanate mixture was milled with the remaining cover components at the same time as injection molding.

The golf balls as well as commercial golf balls (Comparative Examples 15 and 16) were hit for evaluating various properties, with the results shown in Table 8.

Comparative Example 15: practice two-piece ball, Range Altus Softfeel (green), by Bridgestone Sports Co., Ltd.

Comparative Example 16: practice one-piece ball, Bridgestone Range, by Bridgestone Sports Co., Ltd.

TABLE 8

| | | Example | | | Comparative Example | | | | | | | | |
|---|---|---|---|---|---|---|---|---|---|---|---|---|---|
| | | 4 | 5 | 6 | 8 | 9 | 10 | 11 | 12 | 13 | 14 | 15 | 16 |
| | | | | | | Ball tests | | | | | | | |
| Flight | Carry (m) | 252.1 | 253.2 | 253.0 | 253.5 | 251.9 | 248.9 | 252.8 | 251.0 | 247.0 | 246.1 | 254.1 | 239.5 |
| | Total (m) | 264.6 | 266.5 | 265.5 | 266.1 | 263.4 | 258.2 | 259.5 | 259.2 | 259.0 | 258.1 | 267.1 | 250.6 |
| | Spin (rpm) | 2846 | 2759 | 2807 | 2768 | 2824 | 2837 | 2950 | 3003 | 2770 | 2846 | 2748 | 3055 |
| | Rating | ○ | ○ | ○ | ○ | ○ | x | x | x | x | x | ○ | x |
| Control | Spin (rpm) | 5898 | 5759 | 5833 | 5824 | 5863 | 5841 | 6067 | 6158 | 5759 | 5898 | 4258 | 6220 |
| | Rating | ○ | ○ | ○ | ○ | ○ | ○ | ○ | ○ | ○ | ○ | x | ○ |
| Feel W#1 | | ○ | ○ | ○ | ○ | ○ | ○ | ○ | ○ | x | ○ | ○ | ○ |
| Durability to repeated impact | | ○ | ○ | ○ | x | x | ○ | ○ | ○ | ○ | ○ | ○ | ○ |
| Scuff resistance | | ○ | ○ | ○ | x | ○ | ○ | ○ | ○ | ○ | ○ | Δ | ○ |
| Productivity | | ○ | ○ | ○ | ○ | ○ | ○ | ○ | ○ | ○ | ○ | ○ | ○ |

The test methods and the evaluation criteria are shown below.

Flight

Each ball was struck with a driver (W#1) at a head speed (HS) of 50 m/s. The spin rate, carry and total distance of the ball were measured. The driver used was a Tour Stage X500 (loft angle 8°) by Bridgestone Sports Co., Ltd. A ball with a total distance of at least 260 m was rated as good "O" and a total distance of less than 260 m as poor "X."

Control

Each ball was struck with a sand wedge (SW) at a head speed of 20 m/s, and the spin rate of the ball was measured. The club used in the approach shot was J's Classical Edition by Bridgestone Sports Co., Ltd. A ball with a spin rate of at least 5,500 rpm was rated as good "O" and a spin rat of less than 5,500 rpm as poor "X."

Feel

Each ball was actually shot with a driver (W#1) by five professional golfers. The feel of the ball was rated as: good "O" when 4 of the 5 golfers thought the feel was solid and good; and poor "X" when 4 of the 5 golfers thought the feel was too soft.

Durability to Repeated Impact

Each ball was repeatedly struck with a driver (W#1) at a head speed of 50 m/s. The number of strikes required to produce a consecutive decline of 3% in the ball rebound was counted. A relative index was computed based on a value of 100 for the number of catastrophic strikes to the golf ball of Example 4. The ball was rated as: good "O" when the index was at least 80; and poor "X" when the index was less than 50.

Scuff Resistance

Each ball was struck once with a pitching wedge (PW) having angular grooves at a head speed of 45 m/s. The surface of the ball was observed. The ball was rated as: good "O" when usable again, fair "Δ" when usable again, but undesirable because of cover chips stuck to the club face, and poor "X" when no longer usable because of the damaged ball surface.

As seen from Table 8, the golf balls within the second embodiment of the invention are good in all flight distance, control, feel, durability to repeated impact, scuff resistance and productivity, offering excellent overall ball properties. In contrast the golf balls of Comparative Examples 8 to 16 are poor in one or more of flight distance, control, feel, durability to repeated impact, scuff resistance and productivity, and fail to offer excellent overall ball properties.

The performance of the golf balls of Comparative Examples 8 to 16 is discussed in more detail.

Comparative Example 8, in which the cover is made of an ionomer resin and less adherent to the intermediate layer, is less durable to repeated impact and less resistant to scuffing.

Comparative Example 9, in which the intermediate layer is made of an ionomer resin and less adherent to the cover, is less durable to repeated impact.

Comparative Example 10, in which the intermediate layer is softer than the solid core surface and the cover, travels short due to too much spin and less rebound when hit with a driver (W#1).

Comparative Example 11, in which the intermediate layer is softer than the solid core surface, travels short due to too much spin when hit with a driver (W#1).

Comparative Example 12, in which the cover is much softer than the intermediate layer (with a hardness difference of more than 10 in Shore D hardness units), travels short due to too much spin when hit with a driver (W#1).

Comparative Example 13, in which the solid core surface is softer than the intermediate layer (with a hardness difference of more than 10 in Shore D hardness units), gives too soft a feel and travels short due to low rebound.

Comparative Example 14, in which the core is free of an organosulfur compound, is less rebound and travels short.

Comparative Example 15, the two-piece ball with a hard ionomer cover receives too less a spin rate and is very difficult to control.

Comparative Example 16, the one-piece ball is extremely short in distance.

Japanese Patent Application Nos. 2002-063530 and 2002-063520 are incorporated herein by reference.

Although some preferred embodiments have been described, many modifications and variations may be made thereto in the light of the above teachings. It is therefore to be understood that within the scope of the appended claims, the invention may be practiced otherwise than as specifically described.

The invention claimed is:

1. A multi-piece solid golf ball comprising a solid core, at least one intermediate layer enclosing the solid core, and a cover enclosing the intermediate layer, wherein the solid core is formed mainly of a base rubber containing an organosulfur compound, the intermediate layer is formed mainly of a base resin containing at least 50% by weight of a polyurethane elastomer, the cover is formed mainly of a polyurethane elastomer, the intermediate layer and the cover have Shore D hardnesses that meet $0<[(\text{cover Shore D hardness})-(\text{intermediate layer Shore D hardness})]\leqq 20$, the total gage of the intermediate layer and the cover is from 1.5 to 3.2 mm, and the cover is formed of a composition comprising, in admixture, the polyurethane elastomer and an isocyanate mixture of an isocyanate compound having at least two isocyanate groups as functional groups in a molecule, dispersed in a thermoplastic resin which is substantially non-reactive with the isocyanate groups.

2. The golf ball of claim 1 wherein the solid core on its surface has a Shore D hardness of 40 to 58 the intermediate layer has a Shore D hardness of 40 to 55, and the cover has a Shore D hardness of 55 to 61.

3. The golf ball of claim 1 wherein the polyurethane elastomer is thermoplastic.

4. The golf ball of claim 1 wherein the gage of the intermediate layer is up to 1.3 mm.

5. The golf ball of claim 1 wherein the gage of the cover is up to 1.3 mm.

6. The golf ball of claim 1 wherein the Shore D hardness of the solid core surface and the Shore D hardness of the intermediate layer are adjusted to meet $-5\leqq[(\text{intermediate layer Shore D hardness})-(\text{solid core surface Shore D hardness})]\leqq 5$.

7. A multi-piece solid gulf ball comprising a solid core, at least one intermediate layer enclosing the solid core, and a cover enclosing the intermediate layer, wherein the solid core is formed mainly of a base rubber containing an organosulfur compound, the intermediate layer is formed mainly of a base resin containing at least 50% by weight of a polyurethane elastomer, the cover consists essentially of a polyurethane elastomer, the intermediate layer and the cover have Shore D hardnesses that meet $0<[(\text{cover Shore D hardness})-(\text{intermediate layer Shore D hardness})]\leqq 20$, and the total gage of the intermediate layer and the cover is from 1.5 to 3.2 mm, and the intermediate layer consists of a plurality of layers.

* * * * *